US008953968B2

(12) United States Patent
Wayman

(10) Patent No.: US 8,953,968 B2
(45) Date of Patent: Feb. 10, 2015

(54) AIR-BEARING PHOTORECEPTOR BACKER BAR FOR ELIMINATING TRANSFER STREAKS

(71) Applicant: Xerox Corporation, Norwalk, CT (US)

(72) Inventor: William H. Wayman, Ontario, NY (US)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 13/915,085

(22) Filed: Jun. 11, 2013

(65) Prior Publication Data

US 2014/0363193 A1 Dec. 11, 2014

(51) Int. Cl.

| | |
|---|---|
| ***G03G 15/04*** | (2006.01) |
| ***G03G 21/00*** | (2006.01) |
| *G03G 21/20* | (2006.01) |
| *G03G 15/08* | (2006.01) |

(52) U.S. Cl.

CPC ..... *G03G 21/0052* (2013.01); *G03G 21/20* (2013.01); *G03G 21/00* (2013.01); *G03G 15/04* (2013.01); *G03G 15/0898* (2013.01)

USPC ..... 399/98; 15/256.5

(58) Field of Classification Search

CPC ..... G03G 21/00

USPC ..... 15/256.5, 256.51; 399/98

See application file for complete search history.

(56) References Cited

U.S. PATENT DOCUMENTS

| | | | | | |
|---|---|---|---|---|---|
| 3,918,400 | A * | 11/1975 | Cheeseman | 118/261 |
| 4,083,633 | A * | 4/1978 | Shanly | 399/351 |
| 4,411,042 | A * | 10/1983 | Sakata et al. | 15/256.51 |
| 4,984,326 | A * | 1/1991 | Horie et al. | 15/256.5 |
| 5,063,415 | A * | 11/1991 | Ariyama | 399/400 |
| 5,202,735 | A * | 4/1993 | Thayer | 399/102 |
| 5,241,350 | A * | 8/1993 | Bigelow | 399/351 |
| 5,363,182 | A * | 11/1994 | Kuribayashi et al. | 399/350 |
| 5,519,480 | A * | 5/1996 | Thayer et al. | 399/355 |
| 6,253,056 | B1 * | 6/2001 | Lindblad et al. | 399/352 |
| 6,259,882 | B1 | 7/2001 | Lindblad et al. | |
| 6,292,637 | B1 * | 9/2001 | Lindblad et al. | 399/99 |
| 6,418,285 | B1 * | 7/2002 | Casella et al. | 399/162 |
| 6,458,247 | B1 * | 10/2002 | Uuttana | 162/281 |
| 6,751,429 | B1 * | 6/2004 | Wing | 399/164 |
| 8,055,150 | B2 * | 11/2011 | Kim et al. | 399/98 |
| 8,594,552 | B2 * | 11/2013 | Yamamoto et al. | 399/350 |
| 2007/0206981 | A1 * | 9/2007 | Amico et al. | 399/323 |

* cited by examiner

*Primary Examiner* — Clayton E Laballe
*Assistant Examiner* — Kevin Butler
(74) *Attorney, Agent, or Firm* — Fay Sharpe LLP

(57) ABSTRACT

An apparatus for eliminating transfer streaks in a printing system is provided and comprises a hollow transfer backer bar including sealed ends. The transfer backer bar further includes a plurality of holes with the holes spaced along the photoreceptor supporting surface of the transfer backer bar. Air pressure can be applied within a hollow transfer backer bar thereby creating an air flow outward through the holes. The air flow contacts the underside of a photoreceptor and floats the photoreceptor on a thin cushion of air flow during transfer of an image to paper.

11 Claims, 5 Drawing Sheets

AIR-BEARING PHOTORECEPTOR BACKER BAR FOR ELIMINATING TRANSFER STREAKS

BACKGROUND

The disclosure relates generally to an electrostatographic printer or copier, and more particularly concerns a device for removing or preventing transfer streaks on a printout.

In an electrophotographic application such as xerography, a charge retentive surface (i.e., photoconductor, photoreceptor or imaging surface) is electrostatically charged and exposed to a light pattern of an original image to be reproduced to selectively discharge the surface in accordance therewith. The resulting pattern of charged and discharged areas on that surface form an electrostatic charge pattern (an electrostatic latent image) conforming to the original image. The latent image is developed by contacting it with a finely divided, electrostatically attractable powder referred to as "toner". Toner is held on the image areas by the electrostatic charge on the surface. Thus, a toner image is produced in conformity with a light image of the original being reproduced. The toner image may then be transferred to a substrate (e.g., paper), and the image affixed thereto to form a permanent record of the image to be reproduced. Subsequent to transfer, excess toner left on the charge retentive surface is cleaned from the surface. This process is well known, and useful for light lens copying from an original, and printing applications from electronically generated or stored originals, where a charged surface may be image-wise discharged in a variety of ways. Ion projection devices where a charge is image-wise deposited on a charge retentive substrate operate similarly.

One type of charge retentive surface typically utilized in the electrostatographic reproduction device is a photoreceptor belt having a base of flexible material. The photoreceptor belt is entrained about a plurality of support rollers and/or stationary "backer" bars, so as to form a closed loop path. The photoreceptor belt is driven about the closed loop path to present particular areas of the photoreceptor belt sequentially into association with electrographic process stations to form desired reproductions.

Debris particles on the drive roll can cause the coefficient of friction of the drive roller to drop appreciably. The buildup of debris particles on the backside of the photoreceptor belt can also adversely affect the drive roll friction and the drive performance of the photoreceptor belt as it is driven about the closed loop path and, ultimately, affect the overall performance of the reproduction apparatus.

Several mechanisms have been employed for cleaning the backside of the photoreceptor belt. One mechanism includes a stationary pad comprising a material such as cotton. This type of pad can easily become saturated with debris, with the period of time required for the pad to become saturated not readily predictable. Saturation of the pad can cause excessive abrasion and scratching of the photoreceptor belt, thereby necessitating frequent inspection and cleaning.

Printing apparatuses that run heavy (stiff) paper are more sensitive to the long standing problem of transfer white streaks. The aforementioned streaks can typically be 1-3 mm wide and are not present in the image on the photoreceptor before transfer. The streaks result from debris generated from the photoreceptor inner surface that can stick to the stationary transfer photoreceptor backer bar, thereby causing a high spot in the belt photoreceptor in the transfer zone This "tented" high spot causes higher local contact pressure between the paper-toner-photoreceptor interfaces in the transfer zone.

This higher pressure causes a local degradation in transfer efficiency, with less toner making it to the paper. The residual toner (i.e., that should have been on the paper) remains on the photoreceptor and is subsequently cleaned off by a cleaner sub-system.

Light weight papers are generally not affected by the aforementioned increase in contact pressure. Light weight papers are able to conform to the slight waviness of the photoreceptor in the transfer zone. In contrast, heavy weight papers are unable to conform to the photoreceptor waviness, with resulting pressure non-uniformity and subsequent white streaks. Local photoreceptor waviness on the order of 30 microns has been shown to cause transfer streaks.

INCORPORATION BY REFERENCE

Lindblad et al., U.S. Pat. No. 6,292,637 B1, issued Sep. 18, 2001, for "BLADE FOR REMOVING ELECTRICALLY CHARGED PARTICLES FROM THE BACK SIDE OF A BELT IN AN ELECTROSTATOGRAPHIC APPARATUS".

SUMMARY

In accordance with one aspect of the present disclosure, there is provided an apparatus which enables the transfer bar to perform like an air-bearing. In accordance with this aspect, the photoreceptor can be floated on a thin layer of air as it passes over the transfer air-bearing backer bar. This "cushion" of air provides for some compliance in the transfer zone, and results in a contact pressure between the paper-toner-photoreceptor interlaces being more uniform.

An apparatus for eliminating transfer streaks in a printing system is provided and comprises a hollow transfer backer bar including sealed ends. The transfer backer bar further includes a plurality of holes with the holes spaced along the photoreceptor supporting surface of the transfer backer bar. Air pressure can be applied within a hollow transfer backer bar thereby creating an air flow outward through the holes. The air flow contacts the underside of a photoreceptor and floats the photoreceptor on a thin cushion of air flow during transfer of an image to paper.

An apparatus for eliminating transfer streaks in a printing system is provided and comprises a hollow transfer backer bar including sealed ends. The transfer backer bar further includes a porous substrate. The porous substrate can be spaced along the photoreceptor supporting surface of the transfer backer bar. Air pressure can be applied within the hollow transfer backer bar thereby creating an air flow outward through the porous substrate. The air flow contacts an underside of a photoreceptor and floats the photoreceptor on a cushion of air flow during transfer of an image to paper.

An apparatus for eliminating transfer streaks in a printing system is provided and comprises an acoustic transfer assist bar (ATA) including sealed ends. The ATA bar further includes a plurality of holes. The holes can be spaced along the photoreceptor supporting surface of the ATA bar. Air pressure can be applied within the hollow ATA bar thereby creating an air flow outward through the holes. The air flow contacts an underside of a photoreceptor and floats the photoreceptor on a cushion of air flow during transfer of an image to paper.

DETAILED DESCRIPTION

Figure 1:
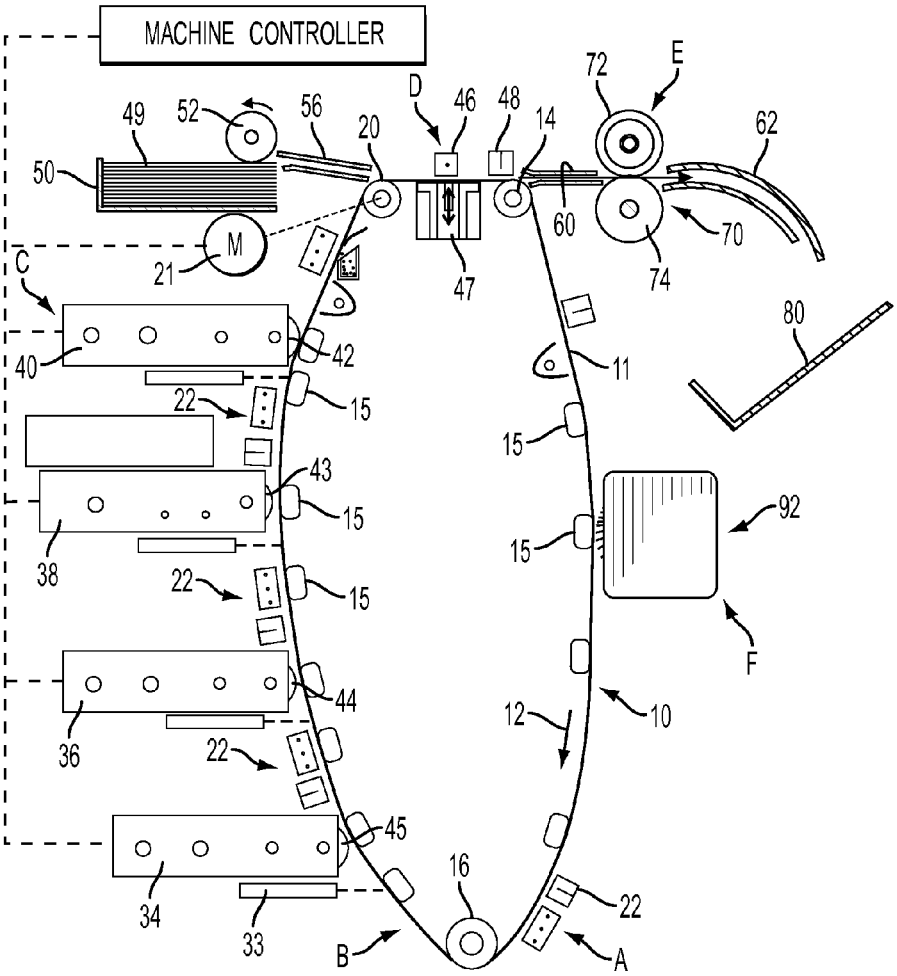
FIG. 1 PRIOR ART
FIG. 1 is a schematic illustration of a printing apparatus for use in incorporating the features of the present disclosure.

For a general understanding of an electrophotographic printer or copier, in which the present invention may be incorporated, reference is made to FIG. 1, which depicts schematically the various components thereof. Hereinafter, like reference numerals have been used throughout to identify identical elements.

Referring now to the drawings, the various processing stations employed in the reproduction machine illustrated in FIG. 1 will be described briefly hereinafter. It will no doubt be appreciated that the various processing elements also find advantageous use in electrophotographic printing applications from an electronically stored original, and with appropriate modifications, to an ion projection device which deposits ions and image configuration on a charge retentive surface.

A reproduction machine, in which the present invention finds advantageous use, has a photoreceptor belt 10, having a photoconductive (or imaging) surface 11. The photoreceptor belt 10 moves in the direction of arrow 12 to advance portions of the belt 10 sequentially through the various processing stations disposed about the path of movement thereof. The belt 10 is entrained about a stripping roller 14, a tension roller 16, a drive roller 20, and backer bars indicated generally as 15. Drive roller 20 is coupled to a motor 21 by suitable means such as a belt drive. The belt 10 is maintained in tension by a pair of springs (not shown) resiliently urging tension roller 16 against the belt 10 with the desired spring force. Both stripping roller 14 and tension roller 16 are rotatably mounted. These rollers are idlers, which rotate freely as the belt 10 moves in the direction of arrow 12.

With continued reference to FIG. 1, initially a portion of the belt 10 passes through charging station A. At charging station A, a corona device 22 charges a portion of the photoreceptor belt 10 to a relatively high, substantially uniform potential, either positive or negative. At exposure station B, a Raster Output Scanner (ROS) 33 exposes the charged portions of photoreceptor belt 10 to record an electrostatic latent image thereon.

Thereafter, the belt 10 advances the electrostatic latent image to developing station C. At development station C, a developer housing 34, 36, 38, or 40 is brought into contact with the belt 10 for the purpose of developing the electrostatic latent image. Each developer housing 34, 36, 38, and 40 supports a developing system such as magnetic brush rolls 42, 43, 44, and 45, which provides a rotating magnetic member to advance developer mix (i.e. carrier beads and toner) into contact with the electrostatic latent image. The electrostatic latent image attracts toner particles from the carrier beads, thereby forming toner powder images on the photoreceptor belt 10.

The photoreceptor belt 10 then advances the developed image to transfer station D. At transfer station D, a sheet of support material such as paper copy sheets is advanced into contact with the developed images on the belt 10. A corona generating device 46 charges the copy sheet to the proper potential so that it becomes tacked to the photoreceptor belt 10 and the toner powder image is attracted from the photoreceptor belt 10 to the sheet. Acoustic Transfer Assist device 47 provides vibrational energy to photoreceptor belt 10 at a frequency sufficient to assist in loosening the toner powder image and thereby facilitating transfer of the image to the sheet. After transfer, the corona generator 48 charges the copy sheet to an opposite polarity to de-tack the copy sheet from the belt 10, whereupon the sheet is stripped from the belt 10 at stripping roller 14.

Sheets of support material 49 are advanced to transfer station D from a supply tray 50. Sheets are fed from tray 50, with sheet feeder 52, and advanced to transfer station D along conveyor 56.

After transfer, the sheet continues to move in the direction of arrow 60, to fusing station E. Fusing station E includes a fuser assembly indicated generally by the reference numeral 70, which permanently affixes the transfer toner powder images to the sheets. Preferably, the fuser assembly 70 includes a heated fuser roller 72 adapted to be pressure engaged with a backup roller 74 with the toner powder images contacting the fuser roller 72. In this manner, the toner powder image is permanently affixed to the sheet, and such sheets are directed via a chute 62 to an output 80 or finisher.

Residual particles, remaining on the image side of photoreceptor belt 10 after each copy is made, may be removed at cleaning station F, represented by the reference numeral 92. At cleaning station 92 residual toner particles are removed and may also be stored for disposal.

Figure 2:
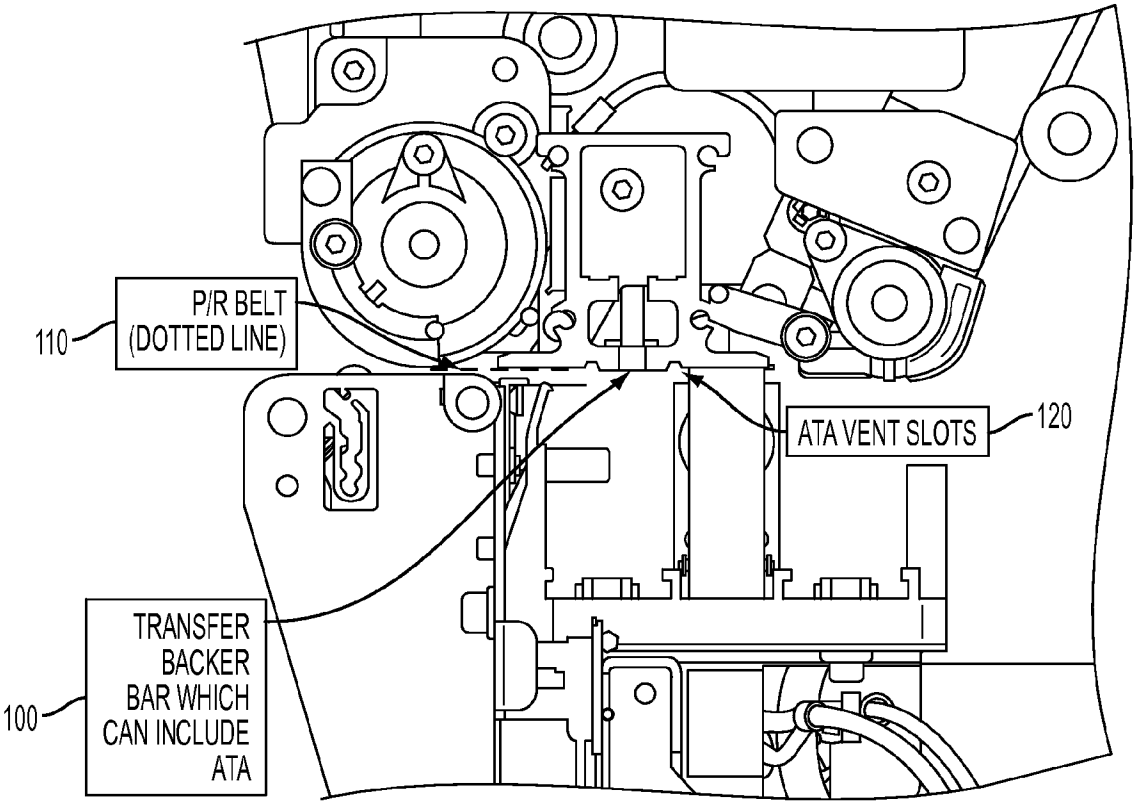
FIG. 2 is a cross sectional view of an exemplary iGen® transfer system for use in incorporating the features of the present disclosure.

FIG. 2 shows a cross-sectional view of an exemplary iGen transfer system for use in incorporating the features of the present disclosure. In particular, a transfer backer bar 100 is shown in associated orientation relative to a photoreceptor belt 110. The backer bar 100 can be an acoustic transfer assist (ATA) backer bar including vent slots or holes 120.

Figure 3:
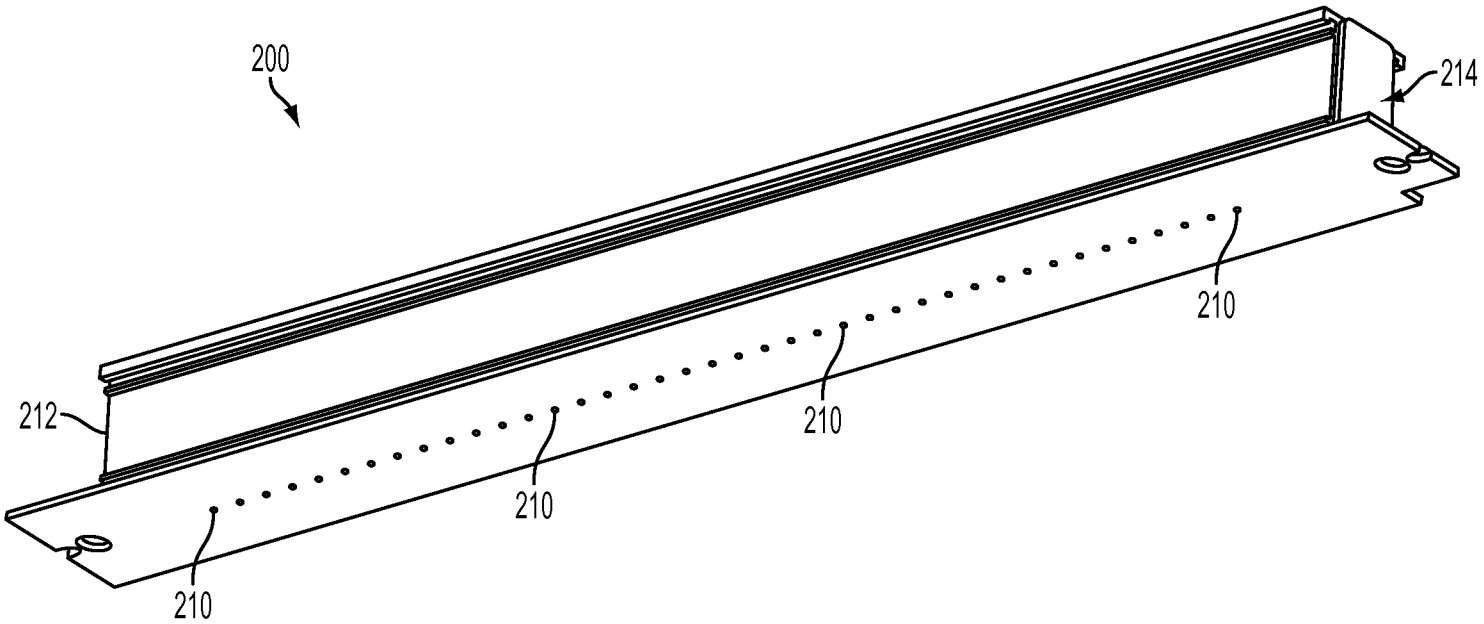
FIG. 3 is a perspective view of a solid air-bearing transfer bar according to a first embodiment.

Referring now to FIG. 3, a first embodiment of a transfer backer bar 200 that has been altered into an air-bearing is therein illustrated. To be described in more detail hereinafter, the photoreceptor can be floated on a thin layer of air as it passes over the transfer air-bearing backer bar 200. The air can float the photoreceptor above any debris (i.e., photoreceptor wear products or other dust that may find its way inside the photoreceptor drive system) that may be stuck on the bar 200. The air flow will also tend to keep the bar 200 clean as the photoreceptor is not rubbing against the bar 200 generating friction and debris.

As shown in FIG. 3, the solid bar 200 can include a series of holes 210 drilled generally down the center of the bar 200. As one illustrated example, a series of twenty 1 mm holes 210 were drilled in an aligned fashion generally down the middle of the transfer bar 200. The backer bar 200 can be sealed at its ends 212, 214 thus creating an enclosed hollow section of the bar 200 which can be used as an air manifold. Air pressure can be supplied to the bar 200 whereby the photoreceptor can be floated on a cushion of air which provides some compliance in the transfer zone. The aforementioned compliance has the effect of eliminating associated transfer streaks. Air flows as low as approximately 10 standard cubic feet per hour (SCFH) can be effective in reducing streaks with heavy weight papers (i.e., 110 lb. cover stock).

Figure 4:
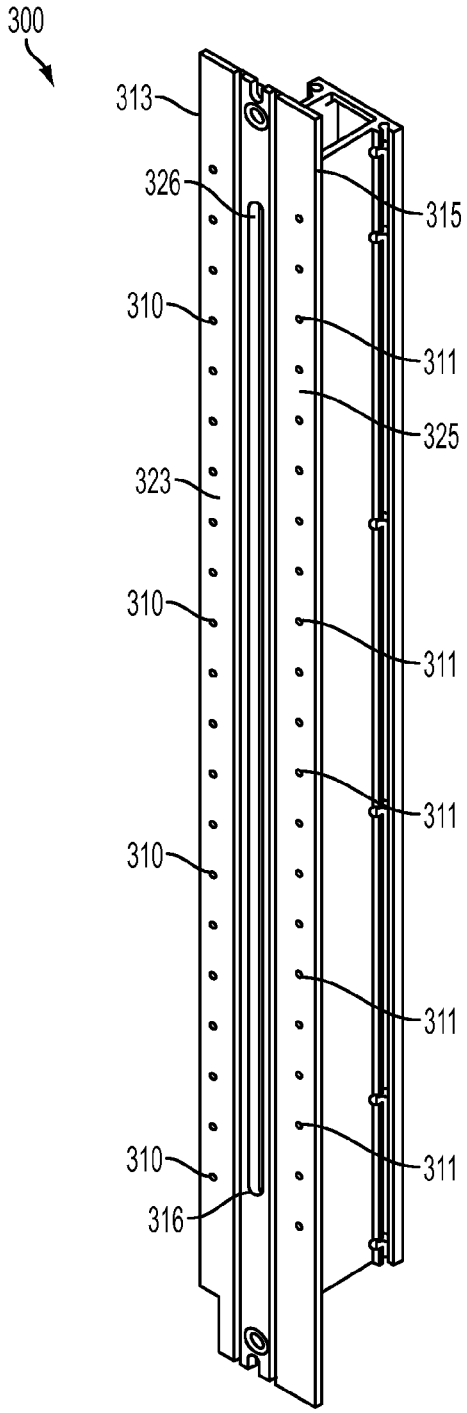
FIG. 4 is a perspective view of an ATA enabled air-bearing transfer bar according to a second embodiment.

If an ATA backer bar 300 (FIG. 4) is used, a row of 1 mm holes 310 (for example) can be drilled on a leading side or edge 313 of the bar 300 and a row of 1 mm holes 311 (for example) can be drilled on a trailing side or edge 315 of the bar 300. The center ATA vacuum coupling region 316 can be located between leading edge 313 and trailing edge 315. The ATA bar 300 can include vent slots (not shown) so there can be isolation between the center vacuum section 316 and the outer air-bearing sections 310, 311. It is to be appreciated, that in both embodiments the hole diameters can be from about 0.1 mm to about 2 mm. In addition, the number and spacing between the holes 210, 310, 311 can be varied. Although illustrated in a substantially straight line, the holes 210, 310, 311 can be aligned in any number of different variations.

In one example, the ATA backer bar 300 can comprise an air manifold including a first left hand area 323 providing an outward air venting area, a second middle section 326 providing an air intake area, and a third right hand area 325 providing still another outward air venting area. It is to be appreciated that the air flow can be in the range from about 2 SCFH to about 100 SCFH.

In yet another embodiment, not illustrated, the holes can be replaced by a porous substrate that enables air flow therethrough to create the air manifold.

Figure 5:
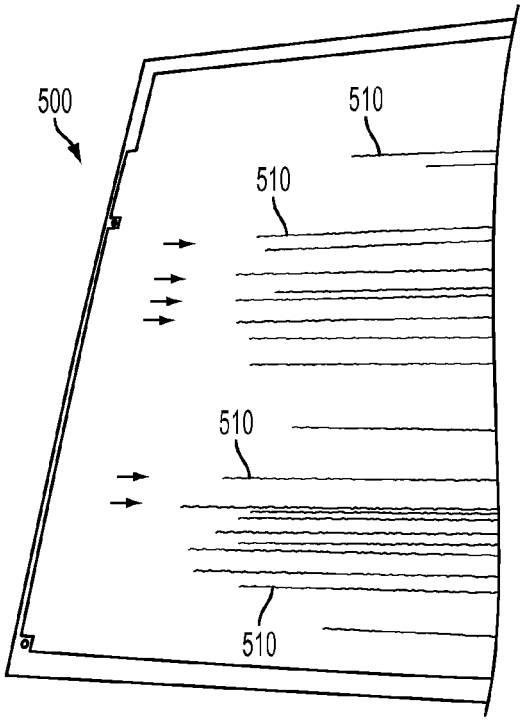
FIG. 5 is an exemplary printout of a printing apparatus through a solid transfer backer bar with no air applied.
Figure 6:
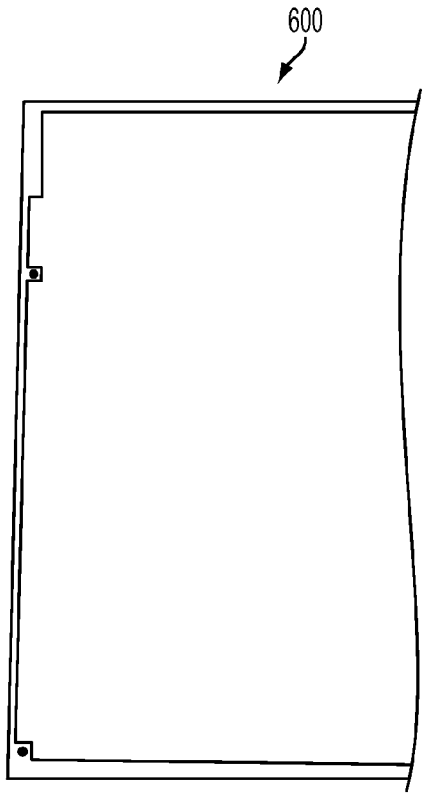
FIG. 6 is a printout from a printing apparatus incorporating a solid transfer backer bar with air applied.

FIG. 5 illustrates a halftone image 500 including numerous white streaks 510 which result from a typical solid transfer backer bar when no air is applied. FIG. 6 illustrates a halftone image 600, without noticeable white streaks, whereby the streaks were eliminated with the application of air (i.e., 50 SCFH) to the air-bearing transfer backer bar. FIGS. 5 and 6 represent depictions of large area mid-tone half-tone photos (approximately 50%).

It is to be appreciated that the air-bearing backer bar 200, 300 as described above can reduce transfer paper-toner-photoreceptor interface pressure non-uniformity. The resultant uniform pressure in the transfer area will reduce white streaks when using heavy weight papers. The photoreceptor can be floated on a thin layer of air as it passes over the transfer air-bearing backer bar. The "cushion" of air provides for some compliance in the transfer zone. The contact pressure between the paper-toner-photoreceptor interlaces is thereby more uniform. In addition, the air will float the photoreceptor above any debris that may be stuck on the bar. The air flow will also tend to keep the bar clean as the photoreceptor is not rubbing against the bar generating friction and debris. Transfer streaks caused by the aforementioned debris buildup can be effectively eliminated by the aforementioned disclosure.

It will be appreciated that variants of the above-disclosed and other features and functions, or alternatives thereof, may be combined into many other different systems or applications. Various presently unforeseen or unanticipated alternatives, modifications, variations or improvements therein may be subsequently made by those skilled in the art which are also intended to be encompassed by the following claims.

What is claimed is:

1. An apparatus for eliminating transfer streaks in a printing system, comprising:
- a hollow transfer backer bar including sealed ends;
- said transfer backer bar further including a plurality of holes;
- said holes spaced along the photoreceptor supporting surface of said transfer backer bar;
- air pressure is applied within said hollow transfer backer bar thereby creating an air flow outward through said holes;
- said air flow contacts an underside of a photoreceptor and floats said photoreceptor along a cushion of said air flow during transfer of an image to paper; and,
- wherein said air flow is from about 2 standard cubic feet per hour to about 100 standard cubic feet per hour.

2. An apparatus for eliminating transfer streaks in a printing system, comprising:
- a hollow transfer backer bar including sealed ends;
- said transfer backer bar further including a plurality of holes;
- said holes spaced along the photoreceptor supporting surface of said transfer backer bar;
- air pressure is applied within said hollow transfer backer bar thereby creating an air flow outward through said holes;
- said air flow contacts an underside of a photoreceptor and floats said photoreceptor along a cushion of said air flow during transfer of an image to paper; and,
- wherein said plurality of holes each having a diameter from about 1 mm to about 2 mm.

3. An apparatus for eliminating transfer streaks in a printing system, comprising:
- a hollow transfer backer bar including sealed ends;
- said transfer backer bar further including a plurality of holes;
- said holes spaced along the photoreceptor supporting surface of said transfer backer bar;
- air pressure is applied within said hollow transfer backer bar thereby creating an air flow outward through said holes;
- said air flow contacts an underside of a photoreceptor and floats said photoreceptor along a cushion of said air flow during transfer of an image to paper; and,
- wherein said plurality of holes including spaces therebetween, said spaces between adjacent said holes are from about 1 mm to about 20 mm.

4. An apparatus for eliminating transfer streaks in a printing system, comprising:
- a hollow transfer backer bar including sealed ends;
- said transfer backer bar further including a plurality of holes;
- said holes spaced along the photoreceptor supporting surface of said transfer backer bar;
- air pressure is applied within said hollow transfer backer bar thereby creating an air flow outward through said holes;
- said air flow contacts an underside of a photoreceptor and floats said photoreceptor along a cushion of said air flow during transfer of an image to paper; and,
- wherein said transfer backer bar is stationary.

5. An apparatus for eliminating transfer streaks in a printing system, comprising:
- an acoustic transfer assist bar including sealed ends;
- said acoustic transfer assist bar further including a plurality of holes;
- said holes spaced along the photoreceptor supporting surface of said acoustic transfer assist bar;
- air pressure is applied within said hollow acoustic transfer assist bar thereby creating an air flow outward through said holes;
- said air flow contacts an underside of a photoreceptor and floats said photoreceptor along a cushion of said air flow during transfer of an image to paper; and,
- wherein said plurality of holes each having a diameter from about 0.1 mm to about 2 mm.

6. An apparatus for eliminating transfer streaks in a printing system, comprising:
- an acoustic transfer assist bar including sealed ends;
- said acoustic transfer assist bar further including a plurality of holes;
- said holes spaced along the photoreceptor supporting surface of said acoustic transfer assist bar;
- air pressure is applied within said hollow acoustic transfer assist bar thereby creating an air flow outward through said holes; and, said air flow contacts an underside of a photoreceptor and floats said photoreceptor along a cushion of said air flow during transfer of an image to paper;

wherein said acoustic transfer assist bar comprises a left hand side portion, a middle portion, and a right hand side portion; and, said left hand side portion includes said holes.

7. The apparatus according to claim 6, wherein said left hand side portion and said right hand side portion includes holes.

8. The apparatus according to claim 6, wherein said air flow is outward through said left hand side holes.

9. The apparatus according to claim 7, wherein said air flow is outward through said left hand side holes and said right hand side holes.

10. The apparatus according to claim 8, wherein said air flow is inward through a seam in said middle portion.

11. The apparatus according to claim 9, wherein said air flow is inward through a seam in said middle portion.

* * * * *